US005509164A

United States Patent [19]

Weill

[11] Patent Number: 5,509,164

[45] Date of Patent: Apr. 23, 1996

[54] COMBINATION BODY AND BACK BATH SCRUBBER

[76] Inventor: Theodore C. Weill, 142 Old Hwy. 98 West, Tylertown, Miss. 39667

[21] Appl. No.: 385,115

[22] Filed: Feb. 7, 1995

[51] Int. Cl.[6] ..... A47K 7/02; A61H 7/00

[52] U.S. Cl. ..... 15/222; 15/227

[58] Field of Search ..... 15/222, 227; 601/137

[56] References Cited

U.S. PATENT DOCUMENTS

| | | |
|---|---|---|
| 660,886 | 10/1900 | Bryan . |
| 1,351,311 | 8/1920 | Virneburg . |
| 1,404,401 | 1/1922 | Novick . |
| 1,473,315 | 11/1923 | Poirier . |
| 1,533,733 | 4/1925 | Gillum . |
| 1,598,574 | 8/1926 | Gibson . |
| 1,730,299 | 10/1929 | Sanders . |
| 2,351,407 | 6/1944 | David . |
| 2,363,697 | 11/1944 | Schirmer . |
| 2,374,068 | 4/1945 | Baldeschwieler . |
| 2,830,313 | 4/1958 | Mountanos . |
| 3,099,032 | 7/1963 | Webb . |
| 3,711,889 | 1/1973 | Jennings . |
| 4,187,575 | 2/1980 | Collins . |
| 4,761,849 | 8/1988 | Taylor . |
| 4,797,967 | 1/1989 | Lengers . |
| 4,803,372 | 1/1990 | Wenzel . |
| 5,295,280 | 3/1994 | Hudson ..... 15/222 |

FOREIGN PATENT DOCUMENTS 258719 11/1946 Switzerland .

*Primary Examiner*—Edward L. Roberts, Jr.

*Attorney, Agent, or Firm*—Price, Heneveld, Cooper, DeWitt & Litton

[57] ABSTRACT

An article for use when bathing includes first and second mitts each having a pocket-defining end for receiving a person's hand and a flap extending from the pocket-defining end. Each mitt is made from opposing panels sewn together to form a pocket in the shape of a person's hand, with one edge of the mitt being left open for access to the pocket. A transverse slot extends parallel the one edge spaced from the open edge to form a handle. A patch of hook-and-loop material is sewn onto the flap and a mating patch of hook-and-loop material is sewn onto the "palm" of the pocket-defining end. The patch and mating patch are releasably engageable to hold the mitt in a folded position, which is conveniently sized to facilitate use as a single-handed scrubber. The patches on the flaps of the first and second mitts is also releasably engageable so that the mitts can be attached to form an elongated article useful for scrubbing a person's back.

17 Claims, 2 Drawing Sheets

COMBINATION BODY AND BACK BATH SCRUBBER

BACKGROUND OF THE INVENTION

The present invention concerns articles for use when bathing and more particularly concerns an article arrangeable in different forms to facilitate completely washing a person's body.

Various articles have been constructed to facilitate bathing, especially for washing difficult to reach locations such as a person's back. However, many known back washing articles include straps or handles that interfere with nodal use, such as when the articles are being used for washing easy-to-reach areas of the body. Further, straps and/or handles detract from the appearance of the articles, add to their expense, and tear loose over time. Also, articles that are long enough to reach across a person's back are cumbersome to use and/or undesirably long when bathing areas other than the person's back. Still further, typical washcloths and back brushes do not provide a scrubbing action strong enough and over a wide enough area to remove all dead cells and unclean matter from a person's back. Thus, an article solving the aforementioned problems is desired.

SUMMARY OF THE INVENTION

In one aspect, the present invention includes an article for use when bathing having first and second mitts. Each mitt includes a pocket-defining end and a flap end. Mating fasteners are located on each of the flap ends for interconnecting the mitts to form an elongated back scrubber, but are also releasable so that the mitts can be separated to form individual scrubbers. In a preferred form, each mitt includes a second fastener for engaging the first fastener to hold the individual mitts in a convenient folded position.

In another aspect, the present invention includes an article for use when bathing having first and second scrubbers each with first and second ends. The first ends each include a transverse slot defining a handle and the second ends each include a fastener configured to releasably engage the other fastener. When the fasteners are engaged, the first and second scrubbers fore an elongated article with handles positioned at opposing ends of the elongated article, such that the elongated article can be used by a person to scrub his or her own back.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
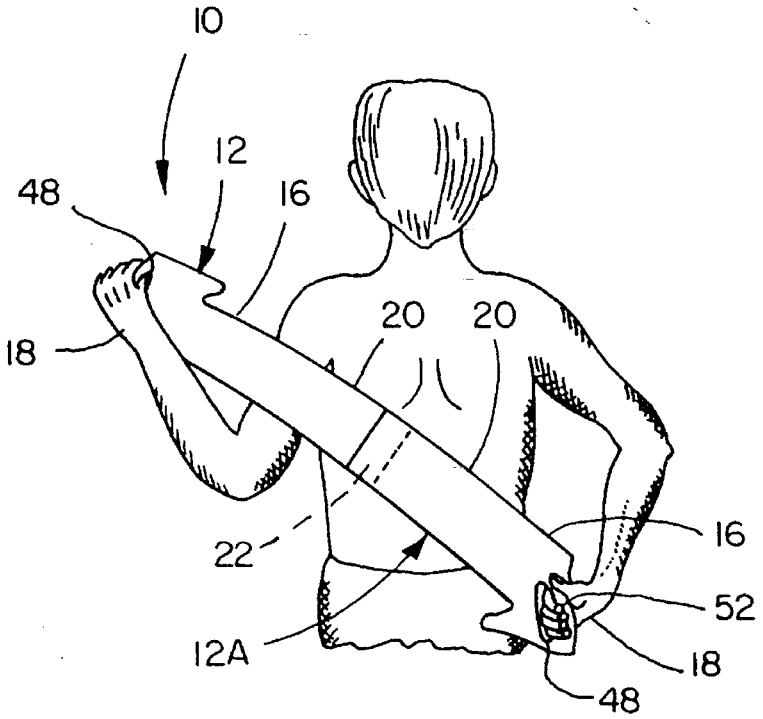
FIG. 1 is a perspective view of an article to facilitate bathing embodying the present invention, the article including a pair of scrubber mitts interconnected to form an elongated scrubber for scrubbing a person's back.
Figure 2:
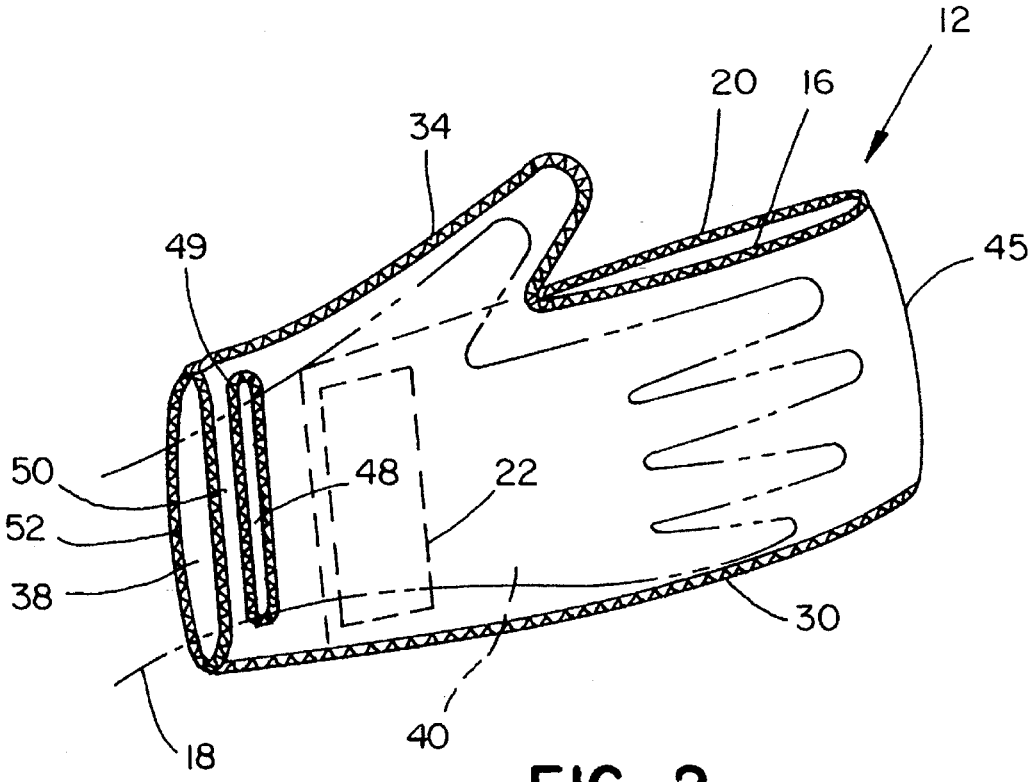
FIG. 2 is a perspective view of one of the scrubber mitts shown in FIG. 1 with a person's hand positioned therein, the mitt being shown in a folded condition.
Figure 6:
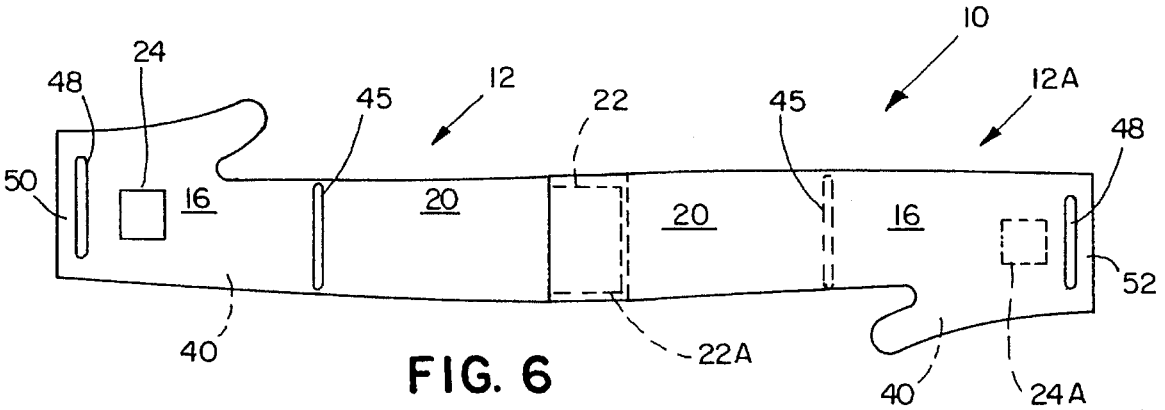
FIG. 6 is a plan view of the scrubbers shown in FIG. 1 interconnected to form an elongated unit.

An apparatus embodying the present invention includes first and second scrubber mitts 12 and 12A that are interconnectable to form an elongated article 10 for scrubbing a person's back (FIGS. 1 and 6). Advantageously, mitts 12 and 12A are also useable as individual washcloths or scrubbers (FIG. 2). Mitts 12 and 12A (FIG. 6) are identical to each other, except that the patches of hook-and-loop material 22 and 24 on mitt 12 are reversed from the mating patches of hook-and-loop material 22A and 24A on mitt 12A, as described below. Specifically, the patches 22 and 22A on mitts 12 and 12A, respectively, provide releasable fastening means, such as hook material and loop material, respectively, for interconnecting the mitts to form the elongated back scrubber arrangement 10. Also, patches 22 and 24, and also the patches 22A and 24A are engageable to hold the individual separate mitts 12 and 12A in a convenient folded condition that is hand-sized for use when scrubbing easy-to-reach areas of a person's body (FIG. 2). Thus, article 10 provides convenient and multi-functional use.

More particularly, each mitt 12 (and 12A) (FIG. 3) includes a pocket-forming end 16 for receiving a person's hand 18, and a flap 20 extending from the pocket-forming end 16. Mating patches 22 and 24 are attached to mitt 12, patch 22 being located proximate the free end of flap 20 on mitt 12, and patch 24 being located proximate the flap remote end of pocket-forming end 16 on mitt 12. Mating patches 22A and 24A are also attached to mitt 12A (FIG. 6), patch 22A being located proximate the free end of flap 20 on mitt 12A, and patch 24A being located proximate the flap remote end of pocket-forming end 16 of mitt 12A. Importantly, patches 22 and 22A are mateably engageable so that mitts 12 and 12A are releasably engageable in the extended interconnected arrangement to form the elongated back scrubber 10. Also, patches 22 and 24 on mitt 12 are mateably engageable, and patches 22A and 24A are engageable. In other words, if patch 22 is hook material, patch 22A on mitt 12A and patch 24 on mitt 12 are loop material. In such case, patch 24A is also hook material. It is contemplated that patches 24 and 24A can be extended across the width of respective mitts 12 and 12A if additional holding strength or wider holding area is desired. Alternatively, other fasteners can be used, such as buttons and button holes, snaps and snap-receiving sockets, buttons and loops, and the like.

Figure 3:
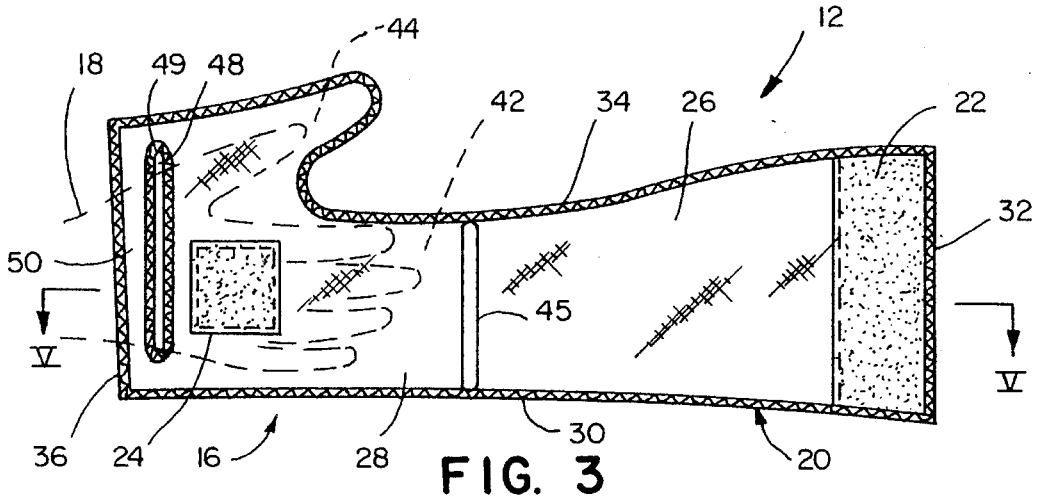
FIG. 3 is a plan view of one of the washcloth mitts shown in FIG. 1, the mitt being shown in an unfolded, extended position.
Figure 4:
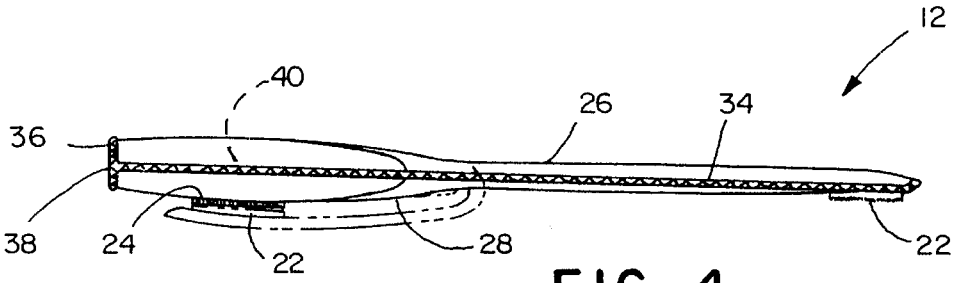
FIG. 4 is an edge view of the mitt shown in FIG. 3.
Figure 5:
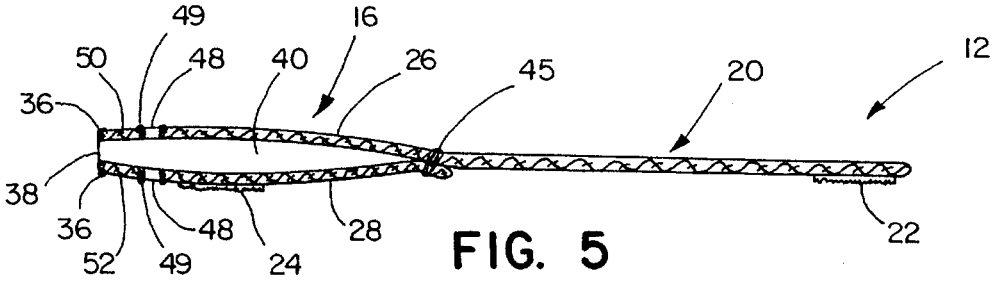
FIG. 5 is a cross-sectional view taken along the line V—V in FIG. 3.

To reduce repetitive discussion, identical numbers are used to describe mitts 12 and 12A, but the letter "A" has been added to distinguish the second mitt 12A from the first mitt 12. Mitt 12 (and mitt 12A) is made from two panels 26 and 28 sewn together along three edges 30, 32 and 34 (FIGS. 3–5). The fourth edge 36 is reinforced by stitching separately on each panel along the edges of the material, but so that a wrist-receiving opening 38 is formed to permit access to the space 40 between panels 26 and 28. Space 40 includes a palm/finger-shaped main space 42 and a thumb-shaped lateral space 44. Space 40 is configured to receive the person's hand 18, with spaces 42 and 44 providing secure retention of mitt 12 on the person's hand 18. Stitching line 45 extends transversely across the middle of panel 26, and both secures panel 28 to panel 26 and also acts as a old line. Panels 26 and 28 can be shaped as desired for aesthetics and function. For example, the edges 30 and 34 can be relatively contoured as shown, or substantially linear.

Mitt 12 is made from a porous material having sufficient strength to be pulled from opposing directions without tearing, such as when the mitts are arranged to form elongated scrubber article 10 for use as a back scrubber. It is contemplated that mitts 12 and 12A will be made from a plastic scrubber material, much like a plastic mesh dish scrubber, such as nonwoven nylon material. Alternatively, it is contemplated that cloth and other moisture absorbent materials can be satisfactorily used. The porosity of the material allows the material to hold and then later dispense soapy water during use. Optimally, the material can be washed and dried in a conventional cloth washer and drier.

Transverse slots 48, reinforced by stitching 49, are formed in panels 26 and 28 in mitt 12 (and mitt 12A) proximate the edge 36 but spaced therefrom. It is contemplated that slots 48 can be any shape or size desired. The strips 50 and 52 of material between edge 36 and slots 48 define a handle that facilitates gripping the elongated article 10. In particular, handle-forming strips 50/52 are located at the opposing ends of elongated article 10, such that they can be grasped for pulling elongated article 10 alternatingly back-and-forth across the person's back.

To use article 10, mitts 12 and 12A are unfolded and patches 22 and 22A are interconnected so that mitts 12 and 12A form the elongated scrubber 10 (FIGS. 1 and 6). A person then grasps the ends of elongated article 10 through transverse slots 50/52 and pulls the article back-and-forth across their back. The scrubber material creates a strong scrubbing action that effectively removes old body cells and matter. Also, soap can be held in the pores of the scrubber material to improve its cleaning properties.

To use as individual washcloths, mitts 12 and 12A are separated by pulling apart hook-and-loop patches 22 and 22A. Mitt 12 is then folded and patches 22 and 24 are engaged. Also, mitt 12 is folded and patches 22A and 24A are engaged. Thus, separate mitts 12 (and 12A) are held in a folded condition (FIG. 2) ready for use as individual hand-held washcloth-like scrubbers. In the folded condition, the mitts 12 and 12A are much like large mittens, but are generally hand-sized so that they can be readily manipulated and are convenient to use. A person then places their hands into pocket 40 through inlet opening 38, and proceeds to use folded mitts 12 and 12A as desired.

Thus, a bath scrubbing article alternatively arrangeable for back scrubbing and rearrangeable for individual single-handed scrubbing is provided. Specifically, the article includes a pair of mitts arrangeable for convenient interconnection and use as a back scrubber, and for convenient disconnection, folding and separate use as hand-held washcloth-sized scrubbers. Having described the invention, it should be understood that although a preferred embodiment has been disclosed herein, other modifications and embodiments can be utilized without departing from the spirit of this invention. Therefore, this invention should not be limited to only the embodiment illustrated.

The embodiments of the invention in which an exclusive property or privilege is claimed are defined as follows:

1. An article for use when bathing, comprising:

first and second mitts each having a pocket-defining end and a flap end; and a fastener located on each of said flap ends of said first and second mitts, said fasteners being releasably engageable such that when engaged, said first and second mitts form an elongated back scrubber, and when disengaged, said first and second mitts are separated so that the mitts form individual scrubbers.

2. An article as defined in claim 1 wherein said pocket-defining ends each include opposing panels of material defining a pocket for receiving a person's hand.

3. An article as defined in claim 2 wherein said pockets each include a first space for receiving a person's fingers and a second space for receiving a person's thumb.

4. An article as defined in claim 2 wherein said pocket-defining ends each include a transverse slot defining a handle.

5. An article as defined in claim 4 wherein said fasteners comprise mating patches of hook-and-loop material.

6. An article as defined in claim 1 including a second fastener located on each of said pocket-defining ends, said second fastener on the respective first and second mitts being configured to releasably engage the first fastener located on the flap end of said respective mitt.

7. An article as defined in claim 6 wherein said first and second fasteners are patches of mating hook-and-loop materials.

8. An article as defined in claim 7 wherein said first fastener on said first mitt is configured to mateably engage said first fastener on said second mitt.

9. An article as defined in claim 1 wherein said pocket-defining ends each include a transverse slot defining a handle.

10. An article as defined in claim 1 wherein said first and second mitts comprise plastic mesh scrubber material.

11. An article for use when bathing, comprising:

first and second scrubbers each having first and second ends, said first ends each including a section of material having a transverse slot cut therein so that a portion of said section of material defines a handle and said second ends each including a fastener, said fastener on said first scrubber being configured to releasably engage the fastener on said second scrubber, said first and second scrubbers forming an elongated article when said fasteners are connected such that said handles are positioned at opposing ends of the elongated article so that a person can conveniently grasp the handles and scrub the person's back, but said elongated articles further being separable for use as separate hand-held scrubbers.

12. An article for use when bathing, comprising:

first and second scrubbers each having first and second ends, said first ends each including a transverse slot defining a handle and said second ends each including a fastener, said fastener on said first scrubber being configured to releasably engage the fastener on said second scrubber, said first and second scrubbers forming an elongated article when said fasteners are connected such that said handles are positioned at opposing ends of the elongated article so that a person can conveniently grasp the handles and scrub the person's back, but said elongated articles further being separable for use as separate hand-held scrubbers, said ends each including opposing panels of material defining a pocket for receiving a person's hand.

13. An article as defined in claim 12 including a second fastener located on each of said ends, said second fastener on the respective first and second scrubbers being configured to releasably engage the first fastener to hold each of said respective scrubbers in a folded condition.

14. An article as defined in claim 13 wherein said first and second fasteners are patches of mating hook-and-loop materials.

15. An article as defined in claim 12 wherein said first and second scrubbers comprise plastic mesh scrubber material.

16. An article for use when bathing comprising:

first and second mitts each having a pocket-defining end for receiving a person's hand and a flap extending from the pocket-defining end, said first and second mitts each being made from opposing panels of material attached together to form a pocket, with one edge of each respective mitt being left open to provide an access for a person's hand, said pocket-defining ends each including a transverse slot that extends parallel the one edge but spaced therefrom such that the material at the one edge forms a handle; and a patch of hook-and-loop material sewn onto each of said flaps and a mating patch of hook-and-loop material sewn onto each of said pocket-defining ends, said patches on the flaps of said first and second mitts being releasably engageable so that said first and second mitts can be attached to form an elongated article useful for scrubbing a person's back, said patches further being releasably engageable with the mating patches on each respective mitt to hold each of said first and second mitts in a folded position such that each respective mitt is conveniently sized to facilitate use as a hand-sized scrubber.

17. An article as defined in claim 16 wherein said pocket includes a first section for receiving a person's thumb and a second section for receiving a person's fingers.

* * * * *